United States Patent [19]

Marchal

[11] 4,089,370

[45] May 16, 1978

[54] COMPACT HEAT-EXCHANGER FOR FLUIDS

[75] Inventor: Philippe Albert Hippolyte Marchal, Boulogne, France

[73] Assignee: Bertin & Cie, Plaisir, France

[21] Appl. No.: 692,917

[22] Filed: Jun. 4, 1976

[30] Foreign Application Priority Data

Jun. 5, 1975 France ..... 75 17517

[51] Int. Cl.[2] ..... F28F 9/02; F28D 7/10

[52] U.S. Cl. ..... 165/159; 165/163

[58] Field of Search ..... 165/157–161

[56] References Cited

U.S. PATENT DOCUMENTS

| | | | |
|---|---|---|---|
| 2,418,191 | 4/1947 | Parrish | 165/156 |
| 2,432,929 | 12/1947 | Parrish | 165/163 X |

FOREIGN PATENT DOCUMENTS

| | | | |
|---|---|---|---|
| 745,914 | 3/1956 | United Kingdom | 165/156 |

*Primary Examiner*—Charles J. Myhre
*Assistant Examiner*—Theophil W. Streule, Jr.
*Attorney, Agent, or Firm*—A. W. Breiner

[57] ABSTRACT

A heat-exchanger for fluids is designed with an outer cylindrical casing and, inside the same, a plurality of coaxial heat-exchange surfaces forming axial flow passageways for fluids therebetween, with two ends each bearing a connection-box for the fluid inlets and outlets. This connection-box is connected to the outer peripheral heat-exchange surface and includes partitions extending from the axis to the periphery and engaging the edges of the heat-exchange surfaces. Obturators join pairs of edges of successive heat-exchange surfaces whereby each end of the succession of heat-exchange surfaces offers annular passageway portions and annular obturated portions.

The outer cylindrical casing is formed by a shell made of thick sheet metal withstanding the pressure forces and said heat-exchange surfaces are formed by thin metal sheets of insufficient strength in themselves but which are buttressed against one another through the agency of spacer means effective in transferring pressure forces to said outer cylindrical casing made of thick sheet metal.

5 Claims, 4 Drawing Figures

COMPACT HEAT-EXCHANGER FOR FLUIDS

This invention relates to heat-exchangers the fluid circulating chambers of which have thin walls made of generally metallic sheet. Being often too thin to withstand the pressure of fluids by themselves, such walls of sheet material are as a rule held apart either by spacers may gauffered and/or open work sheet material or by deformations formed in the sheet walls themselves; or by both methods together.

Such heat-exchangers can be formed by a stack of flat plates, but the forces due to the pressure on the end plates limit the size and service pressure of such heat-exchangers. It is also known to use spiral-wound sheet metal, but such commercially available heat-exchangers are ill-suited to high pressures and high outputs because at least one fluid passes through ends which are parallel to the winding axis, said fluid following a spiral path.

Lastly, P. Rebuffe's French patent Ser. No. 2,045,691 describes spiral heat exchangers in which the inflow and outflow of a same fluid are effected through the same face, longitudinal baffles separating the spiral spaces into ring portions and allowing the fluid to flow out and back. But such heat-exchanger is not a pure counter-streaming heat-exchanger; it causes a high pressure loss because of the sudden out and back flow path, and above all it poses shaping and welding problems.

These types of spiral-wound heat-exchangers are advantageous because they permit absorption of the pressure forces by cylindrical ring shells.

This invention relates to a welded heat-exchanger with two or more fluids, capable of being used in the counterstreaming mode.

The principle on which such heat exchange is based allows the use of roll-welded concentric metal sheets as well as spiral-wound sheets.

A heat-exchanger according to this invention comprises cylindrical or spiral sheels substantially concentric with an axis and forming annular axial-flow passages for fluids, having a connection-box at each end for the fluid inlets and outlets that connects to the outer shell-ring or spiral turn and which includes partition walls extending from the axis to the periphery and in contact with the ends of the shells, further comprising obturating means joining pairs of ends of successive shells whereby each end provides annular passageway portions and annular obturated portions, characterized in that said obturating means form circle segments the ends of which meet partition walls at their contact points with the ends of the shells.

The shell-forming sheets are kept spaced apart either by their own rigidity due to their cylindrical shape or by deformations in the sheets themselves, or by spacers or gauffered and/or open-work sheets forming corrugated inserts for example, the end sheet being of sufficient thickness to absorb the pressure forces.

The obturations at each end can be provided by alternately disposing, between the edges of two adjacent sheets, when same are stacked or wound, circular segment-shaped spacing strips of breadth equal to the spacing between the adjacent sheets, which spacing defines the width required for an annular passageway, said strips being set alternately astride common radii of the heat-exchanger, thereby enabling two continuous welds to be used to separate fluid flow spaces bounded by cylindrical or spiralwound sheet and by said strips.

Accordingly, for the purpose of welding along these common radii a partition wall between two fluids in the connection boxes, there is available a thickness of metal which is homogeneous with the thickness of the partition wall to enable the junction weld to be effected easily.

Such method of connecting the cylindrical ring ducts makes it possible to obtain all combinations, including those obtained in heat-exchangers with brazed light-alloy plates. It is to be noted that each fluid flows longitudinally, that is, axially of the heat-exchanger through each ring, and that its entrance and exit are limited to a half-ring, the entrance being at one end and the exit at the other but not necessarily facing each other.

In particular, it is possible to provide the intake and discharge for a fluid by means of a 180° connection box or by means of two 90° boxes positioned symmetrically in relation to the axis in order to improve distribution of the fluid through the cylindrical ring-shaped passageways.

It it likewise possible to provide a heat-exchanger for three or more fluids by providing obturating means disposed in accordance with the invention for selecting in each connection-box the passageways associated to each fluid.

Lastly, it is possible to adapt the thickness of each passageway by stacking more or less extensively deformed sheets or spacers of varying breadth whereby to match the hydraulic radius of each passageway to the fluid flowing therethrough in order to balance the heat transfer coefficients and the pressure losses and optimize the whole for individual applications.

The description which follows with reference to the accompanying non limitative exemplary drawings will give a clear understanding of how the invention can be carried into practice.

Figures 1, 4:
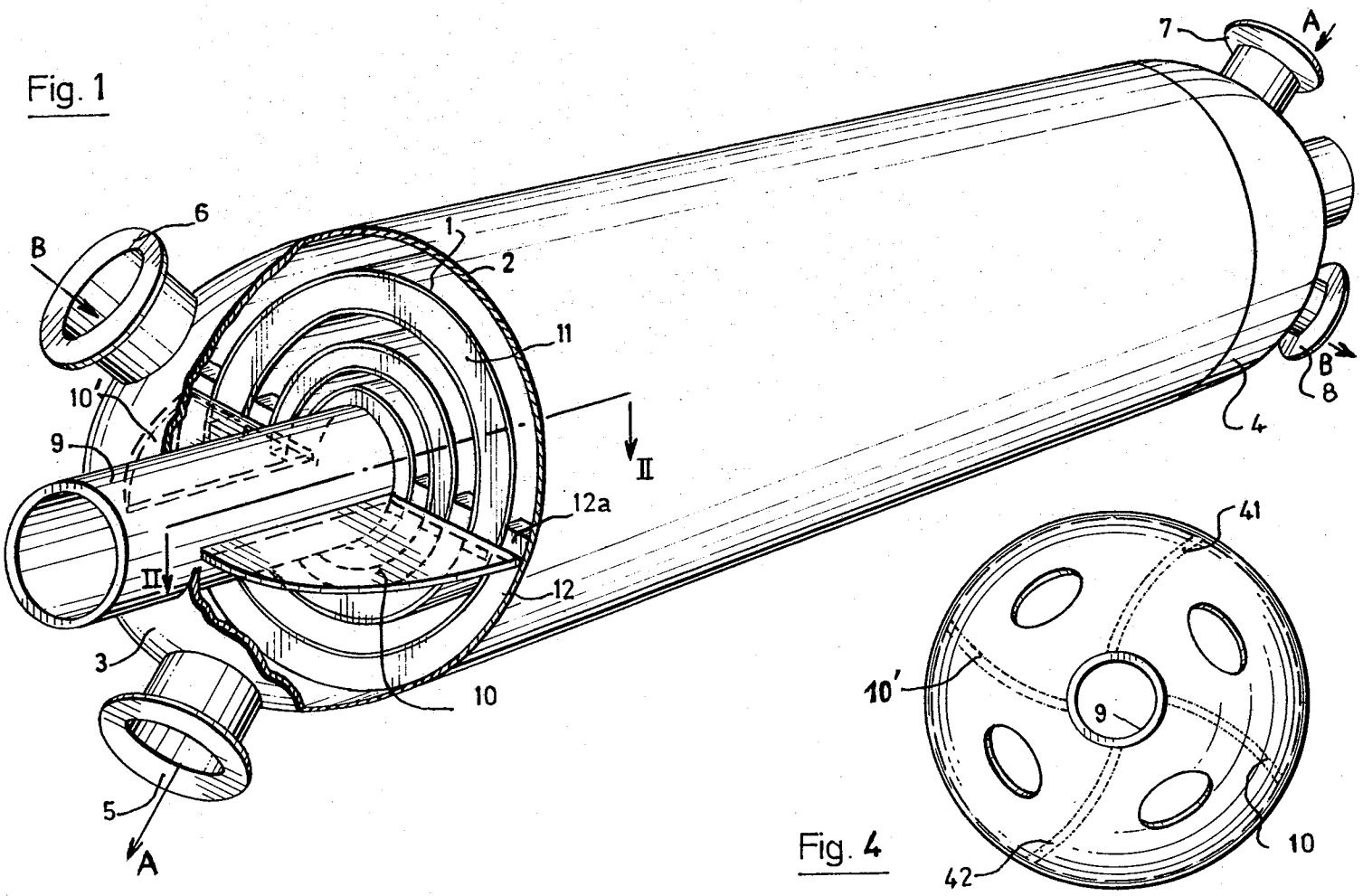
FIG. 1 is a perspective view, with partial cutaway, of one embodiment of the invention.
FIG. 4 is a schematic illustration of an alternative embodiment of a connection box.
Figure 2:
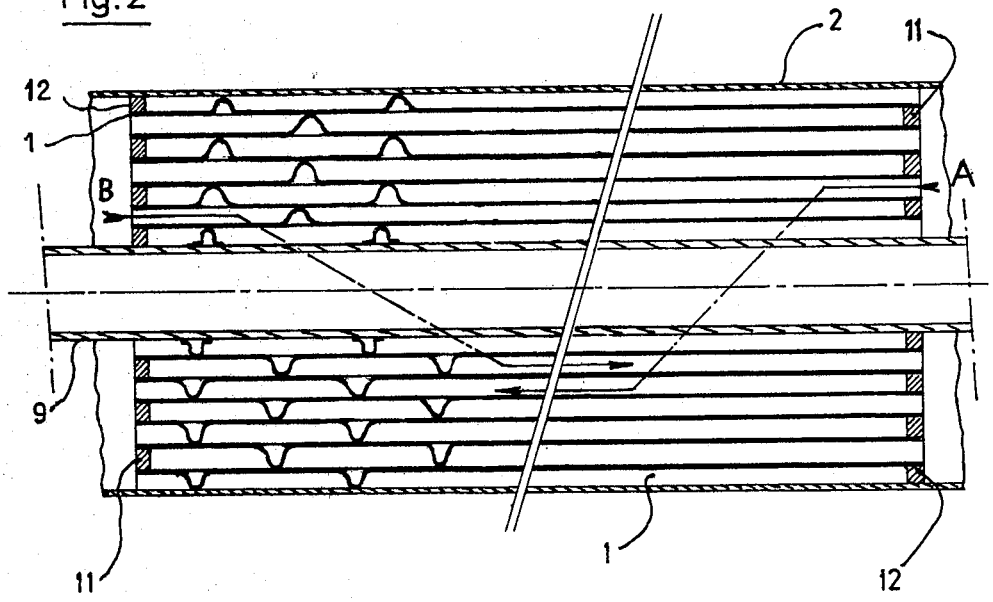
FIG. 2 is a partial section taken through the line II—II of FIG. 1.

Referring first to FIGS. 1 and 2, the heat-exchanger shown thereon includes six shells 1 of equal length arranged in concentric succession.

An outer shell 2, itself of substantially the same length, forms the outer body of the heat-exchanger. It is joined, usually by welding, to dished end-faces 3 and 4 forming connection-boxes for two fluids (hereinafter referred to as A and B) and having two connection flanges, the directions of flow being indicated by arrows:

fluid B inlet, reference numeral 6
fluid A exit, reference numeral 5
fluid A inlet, reference numeral 7
fluid B exit, reference numeral 8.

A tubular shaft 9 is placed inside the shell of smallest diameter. The shaft 9, the six shells 1 and the outer shell 2 jointly define seven coaxial rings for flow of the fluids A and B.

In accordance with this invention, the circuits for these two fluids in the heat-exchanger are separated by the following means.

Inside each connection box is fixed a partition wall 10 extending from the axis to the periphery whereby to define two fluid flow chambers.

In this case the tubular shaft 9 extends beyond the shells and is welded to the tops of the dished end-faces, and said partition wall 10 is made of two parts 10 and 10', welded to shaft 9 and dished end-face 3. If this shaft were shorter, it would have to be sealed off at each end, the ends being welded to partition wall 10.

Inserted at each end of the shells are spacing and sealing strips 12 in the exit chamber for fluid A, and 11 in the inlet chamber for fluid B.

The strips 11 obstruct one out of every two flow rings, and this only in the associated inlet or exit chamber, that is to say over a semi-circle in this case.

The strips 12 obstruct the other flow-rings, but only in the corresponding inlet chamber.

However, the ends of the semi-circles formed by the strips intersect slightly level with the half-partitions 10 and 10', such as at **12*a* in the case of strip 12**.

The line of intersection of said strips accordingly forms a linear zone of thick metal onto which the partition wall 10 can readily be welded. This is one of the advantages of the invention because the sheet metal of the shells 1, being thin in order to assist heat transfer, would otherwise be difficult to join to the partition walls 10, which are made of thick metal like the shafts 9, the outer shells 2 and the end-faces 3 and 4.

It may be noted that the intersections, instead of occurring over a straight radius as in FIG. 1, could alternatively follow a circular radius, making it possible for partition wall 10, 10' to be bulged in order to better withstand the pressure loads, vibration and differential expansions.

Lastly, the partition-wall thrust radii may lie in arbitrarily chosen planes, and in particular the inlet and exit chambers contained in the connection-boxes and the associated flanges may be chosen in any desired orientation that assists internal flow of the fluids or the connections to the load conduit.

Figure 3:
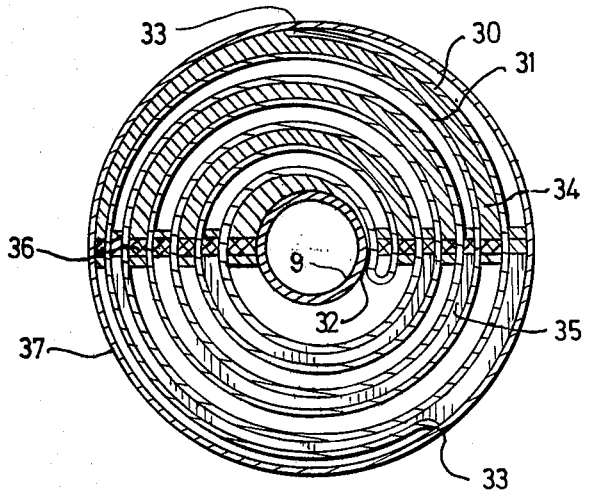
FIG. 3 is an end view of an alternative embodiment; the connection box having been removed.

The cylindrical shells may be replaced by two spiral-wound metal sheets, as shown in FIG. 3, in which such sheets 30 and 31 are united axially at the center at 32 and at the periphery at 33 whereby to define two independent spiral chambers. These chambers are crossed axially by the two fluids which, as in the embodiment described precedingly, are distributed by spacing and sealing strips 34, 35 cooperating with the partition wall 36 and with the connection-box (not shown) which is joined to the outer cylindrical casing 37.

It is to be noted that the axial tube 9 described with reference to FIG. 1 is not necessary in this case. It may alternatively be crossed by one of the two fluids, or else by a third fluid participating in the heat transfer process.

The connection-boxes may bear additional partition walls, as shown in FIG. 4. These additional walls 41, 42 make it possible, depending on the disposition of the sealing strips of the fluid flow rings, either to feed a given ring with the same fluid through two sectors opposed to each other relative to the axis, or to define three or four independent sets of rings for a heat transfer process utilizing three or more fluids. The partition walls 10, 10' and 41, 42 shown in profile in dash-lines are in this case bulged, as mentioned precedingly, mainly in order to withstand the differential expansions.

An exemplary heat-exchanger according to this invention could consist of an axial tube 500 mm in diameter, 167 lmm-thick heat transfer shells spaced 2 mm apart by stamped parts staggered along the length of the axis as shown in FIG. 2, and an outer shell 1500 mm in diameter, 2.66 m long and 6 mm thick. Such a heat-exchanger provides a heat transfer area of 1400 $m^2$ for a weight of 19 metric tons. It is preferably made of low-carbon steel, and most notably of stainless nickel-steel because of its ready weldability and great elongation capability in addition to its well-known resistance to corrosion.

A heat-exchanger according to the invention is additionally advantageous because it requires lengths five to ten times shorter than is needed on a flat heat-exchanger, and furthermore such welds are less difficult to effect and can easily be automated.

The invention can find application in all industrial fields, particularly in chemical or nuclear engineering and air conditioning applications.

I claim:

1. A heat exchanger for fluids comprising the combination of:

an outer cylindrical casing formed of a shell made of relatively thick metal sheet capable of withstanding the mechanical stresses due to pressure forces developed during operation of the heat exchanger, a series of generally coaxial heat-exchange surfaces housed inside said casing shell and defining therebetween axially-extending fluid flow passageways, and heat-exchange surfaces being formed of relatively thin metal sheet incapable by itself of withstanding said mechanical stresses, spacer means mechanically interconnecting said casing shell and surfaces to buttress the same against each other for transferring said mechanical stresses to said casing shell, two opposite end closures respectively fitted at the opposite ends of said casing shell and defining therewith an overall enclosure containing said fluid flow passageways, fluid inlet and outlet union means on both said end closures, transverse partition means extending within said end closures from the axis to the periphery thereof and engaging the thin edges of said heat-exchange surfaces, to define at least two separate end manifolds communicating with said fluid flow passageways, each manifold further communicating with a respective one of said union means, a first set of arcuate obturators plugging one end of every other fluid flow passageway at one of said end manifolds, and a second set of arcuate obturators plugging one end of the other fluid flow passageways at another of said end manifolds, said first and second sets of arcuate obturators being in staggered formation and defining with said fluid flow passageways, manifolds and union means at least two mutually segregated paths of said fluids in heat-exchange relationship, and said arcuate obturators being of an excessive length with respect to the strict plugging function thereof relative to the corresponding manifold and substantially overriding said transverse partition means to extend beyond the same in the other manifold.

2. Heat exchanger as claimed in claim 1, wherein said end closures comprise terminal bulges welded to said casing shell and to the outer peripheral portion of said transverse partition means, and wherein said transverse partition means are further welded along the inner peripheral portion thereof on said arcuate obturators short of the overriding ends thereof.

3. Heat exchanger as claimed in claim 2, wherein said transverse partition means define more than two separate end manifolds, and wherein said obturators define with said fluid flow passageways, manifolds and union means more than two segregated fluid paths.

4. Heat exchanger as claimed in claim 3, wherein said transverse partition means are bulged at the inner peripheral portion thereof which is welded to said overriding arcuate obturators.

5. Heat exchanger as claimed in claim 2, further comprising an axially-extending innermost tube made of relative thick metal sheet likewise to said casing shell and in contrast to said heat-exchange surfaces.

* * * * *